US009273489B2

(12) United States Patent
Hickman

(10) Patent No.: US 9,273,489 B2
(45) Date of Patent: Mar. 1, 2016

(54) LOCK ASSEMBLY HAVING MOTOR INSIDE INTERIOR OPERATOR HANDLE

(71) Applicant: Stanley Security Solutions, Inc., Indianapolis, IN (US)

(72) Inventor: Chad A. Hickman, Rensselaer, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 151 days.

(21) Appl. No.: 14/105,783

(22) Filed: Dec. 13, 2013

(65) Prior Publication Data

US 2014/0165677 A1 Jun. 19, 2014

Related U.S. Application Data

(60) Provisional application No. 61/738,980, filed on Dec. 18, 2012.

(51) Int. Cl.

| | |
|---|---|
| ***E05B 15/16*** | (2006.01) |
| ***E05B 15/00*** | (2006.01) |
| ***E05B 47/00*** | (2006.01) |

(52) U.S. Cl.

CPC ..... *E05B 15/16* (2013.01); *E05B 15/00* (2013.01); *E05B 47/0012* (2013.01); *Y10T 70/5199* (2015.04); *Y10T 70/7062* (2015.04)

(58) Field of Classification Search

CPC . E05B 47/0012; E05B 47/0692; E05B 81/06; E05B 47/00; E05B 47/0673; E05B 63/16; E05B 15/0033; E05B 81/90; E05B 47/068; E05B 2047/0026; E05B 47/0661; E05B 47/0004; E05B 47/0649; E05B 63/08

USPC ..... 70/277, 279.1, 283, 472, 222; 292/201, 292/144

See application file for complete search history.

(56) References Cited

U.S. PATENT DOCUMENTS

| | | | | |
|---|---|---|---|---|
| 3,894,417 | A * | 7/1975 | Taniyama | 70/156 |
| 4,073,527 | A * | 2/1978 | Schlage | 292/347 |
| 4,736,970 | A * | 4/1988 | McGourty et al. | 292/359 |
| 5,018,375 | A * | 5/1991 | Tully | 70/472 |
| 5,083,122 | A * | 1/1992 | Clark | 340/5.22 |
| 5,421,178 | A * | 6/1995 | Hamel et al. | 70/283 |
| 5,628,216 | A * | 5/1997 | Qureshi et al. | 70/278.7 |
| 5,694,798 | A * | 12/1997 | Nunez et al. | 70/283 |
| 5,782,118 | A * | 7/1998 | Chamberlain et al. | 70/278.3 |
| 5,933,086 | A * | 8/1999 | Tischendorf et al. | 340/5.22 |
| 5,960,656 | A * | 10/1999 | Yao | 70/472 |
| 6,412,318 | B1 * | 7/2002 | Shen | 70/217 |

(Continued)

*Primary Examiner* — Suzanne Barrett
(74) *Attorney, Agent, or Firm* — Richard J. Veltman

(57) ABSTRACT

A lock assembly includes an exterior operator assembly having an exterior operator handle. An interior operator assembly has an interior operator handle having a mounting opening. An outer spindle is operatively coupled to a latch assembly, drivably coupled to the interior operator assembly, has a longitudinal bore, and is rotatable about a first axis. A coupling mechanism is drivably coupled to the outer spindle. A locking spindle assembly is rotatably received in the longitudinal bore and rotatable about the first axis, and is configured to selectively operate the coupling mechanism to drivably couple the exterior operator assembly to the outer spindle. A motor drive assembly includes a motor having a motor shaft. The motor is positioned inside the mounting opening of the interior operator handle. The motor shaft is drivably coupled to the locking spindle assembly to operate the coupling mechanism when the motor drive assembly is actuated.

15 Claims, 7 Drawing Sheets

(56) References Cited

U.S. PATENT DOCUMENTS

| | | | | |
|---|---|---|---|---|
| 6,865,916 | B2 * | 3/2005 | Goldman | 70/472 |
| 7,003,993 | B1 * | 2/2006 | Zehrung | 70/278.7 |
| 7,231,791 | B2 * | 6/2007 | Sakai | 70/277 |
| 7,918,114 | B2 * | 4/2011 | Walsh, III | 70/283 |
| 7,963,134 | B2 * | 6/2011 | Rafferty et al. | 70/218 |
| 8,051,689 | B1 * | 11/2011 | Shen et al. | 70/224 |
| 8,302,438 | B2 * | 11/2012 | Lui | 70/277 |
| 8,356,499 | B2 * | 1/2013 | Peng | 70/283 |
| 8,739,586 | B2 * | 6/2014 | Yuan | 70/278.7 |
| 8,887,542 | B2 * | 11/2014 | Bogdanov et al. | 70/277 |
| 2009/0025438 | A1 * | 1/2009 | Don et al. | 70/224 |

* cited by examiner

LOCK ASSEMBLY HAVING MOTOR INSIDE INTERIOR OPERATOR HANDLE

CROSS-REFERENCE TO RELATED APPLICATIONS

This is a non-provisional application based upon U.S. provisional patent application Ser. No. 61/738,988, entitled "LOCK ASSEMBLY HAVING MOTOR INSIDE INTERIOR OPERATOR HANDLE", filed Dec. 18, 2012, from which priority is claimed, and which is incorporated herein by reference in its entirety.

BACKGROUND OF THE INVENTION

1. Field of the Invention

The present invention relates to door locks, and, more particularly, to a lock assembly having a motor inside the interior operator handle.

2. Description of the Related Art

A typical motorized lock assembly has a motor for effecting the movement of a latch bolt, such as for example, from an extend position to a retracted position to facilitate the opening of a door. In one such motorized lock assembly, the motor is positioned off-axis from the drive spindle. In such an arrangement, however, the motor requires dedicated space on the lock chassis.

What is needed in the art is a lock assembly having a motor inside the interior operator handle.

SUMMARY OF THE INVENTION

The present invention provides a lock assembly wherein the motor is located inside the interior operator handle, and wherein the motor may be co-axial with the locking spindle assembly that operates the locking mechanism of the lock assembly.

The invention, in one form thereof, is directed to a lock assembly for a door. The lock assembly includes an exterior operator assembly having an exterior operator handle. An interior operator assembly has an interior operator handle. The interior operator handle has a mounting opening. A latch assembly has a bolt actuator mechanism and a bolt. An outer spindle is operatively coupled to the latch assembly and drivably coupled to the interior operator assembly. The outer spindle has a longitudinal bore and is rotatable about a first axis. A coupling mechanism is drivably coupled to the outer spindle. A locking spindle assembly is rotatably received in the longitudinal bore and rotatable about the first axis, and is configured to selectively operate the coupling mechanism to drivably couple the exterior operator assembly to the outer spindle. A motor drive assembly includes a motor having a motor shaft. The motor is positioned inside the mounting opening of the interior operator handle. The motor shaft is drivably coupled to the locking spindle assembly to operate the coupling mechanism when the motor drive assembly is actuated.

The invention, in another form thereof, is directed to a lock assembly for use with a door. The lock assembly includes a latch assembly having a bolt actuator mechanism and a bolt. An outer spindle is operatively coupled to the bolt actuator mechanism of the latch assembly. The outer spindle has a first end and a second end. The outer spindle has a longitudinal bore and is configured for rotation about a first axis. An exterior lockset includes an exterior operator assembly and a credential reader. The exterior operator assembly has an exterior operator handle. A coupling mechanism is drivably coupled to the second end of the outer spindle, and is configured to selectively couple the exterior operator assembly to the outer spindle. A locking spindle assembly is rotatably received in the longitudinal bore of the outer spindle for rotation about the first axis. The locking spindle assembly includes a locking spindle tail member that extends from the first end of the outer spindle, and a locking actuator spindle that extends from the second end of the outer spindle. The locking actuator spindle is configured to selectively operate the coupling mechanism to drivably couple the exterior operator assembly to the outer spindle. An interior lockset includes an interior operator assembly and a motor drive assembly. The interior operator assembly includes an interior operator handle drivably coupled to the first end of the outer spindle. The interior operator handle has a mounting opening configured to receive the motor drive assembly. The motor drive assembly is electrically coupled to the credential reader. The credential reader is configured to selectively actuate the motor drive assembly. The motor drive assembly includes a motor having a motor shaft rotatable about the first axis. The motor shaft is drivably coupled to the locking spindle tail member of the locking spindle assembly to operate the coupling mechanism when the motor drive assembly is actuated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
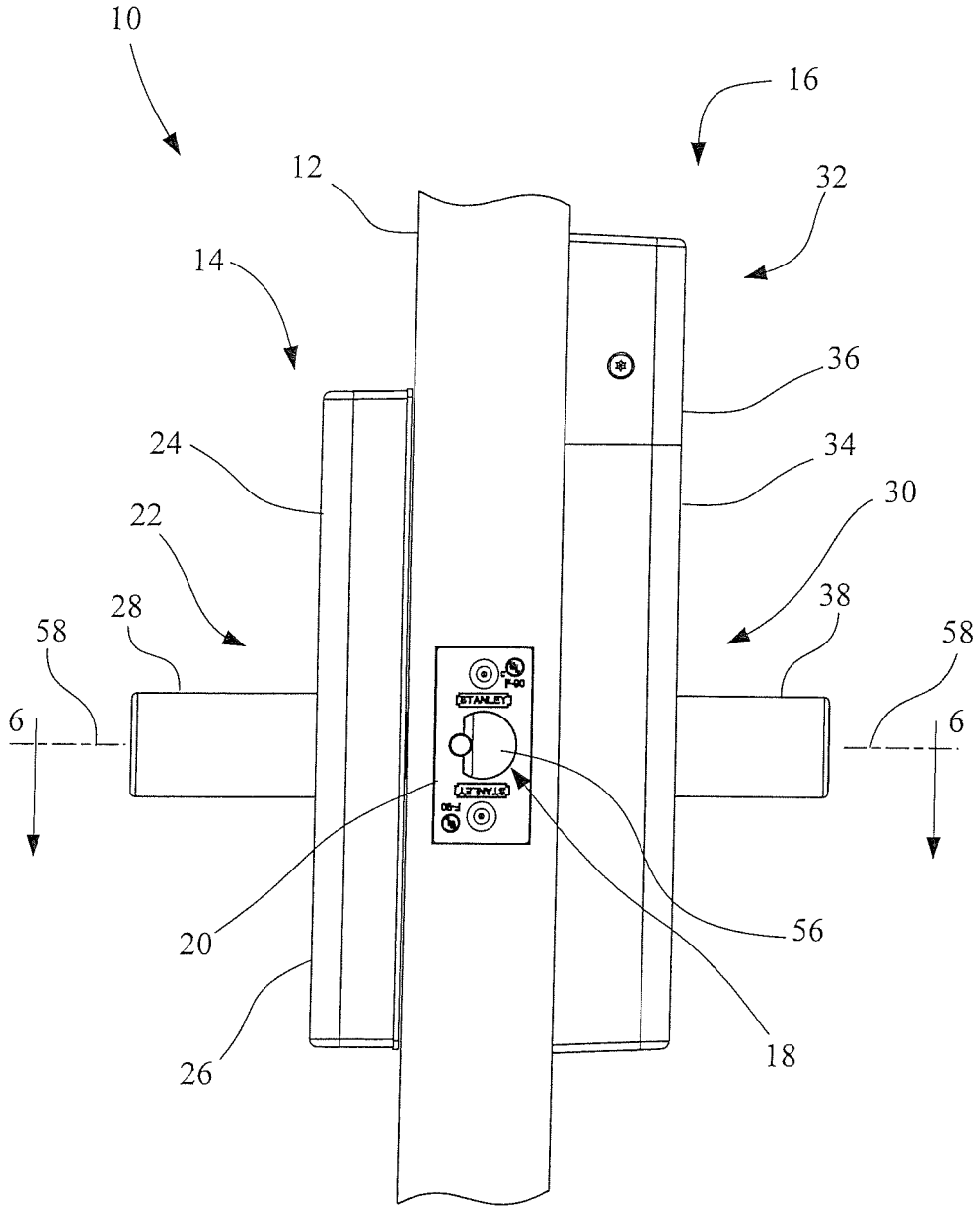
FIG. 1 is a door edge view of a lock assembly in accordance with an embodiment of the present invention, installed on a door.
Figure 2:
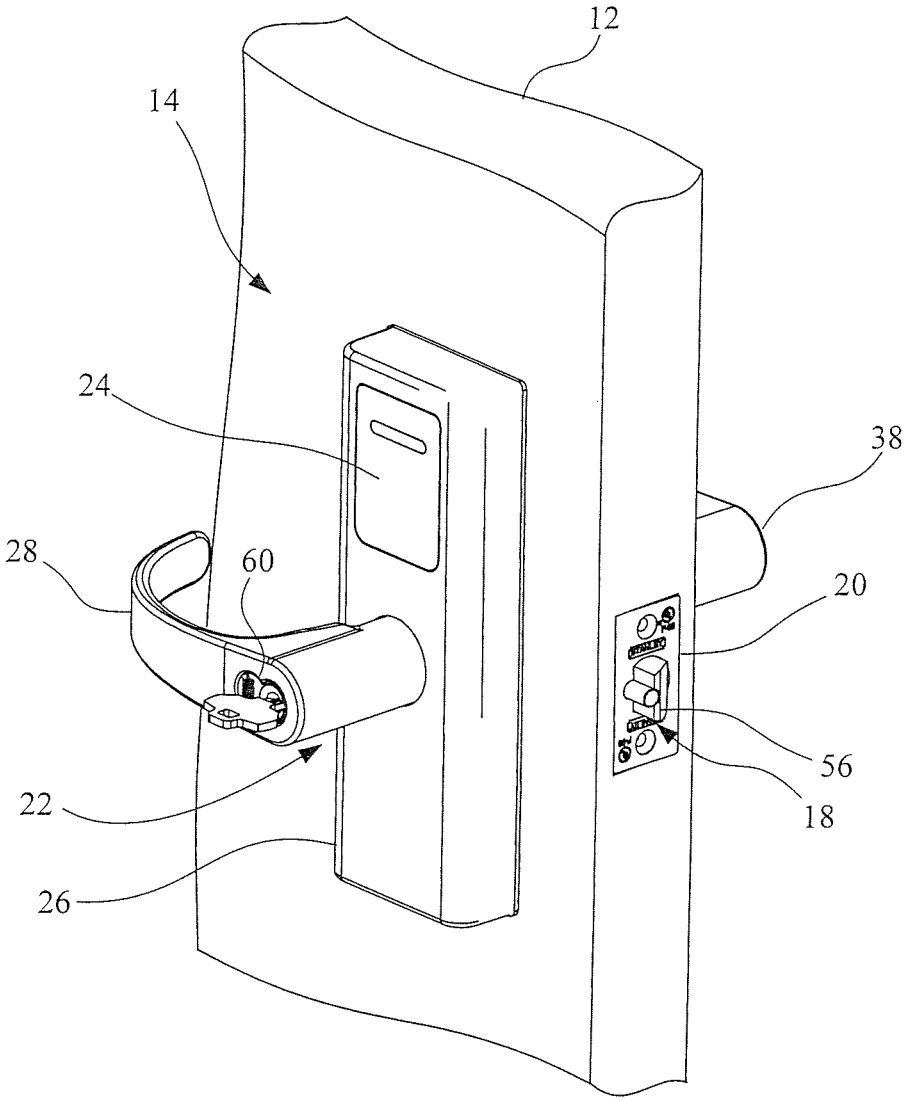
FIG. 2 is a perspective view of the exterior lockset of the lock assembly of FIG. 1, as viewed from the exterior of the door.
Figure 3:
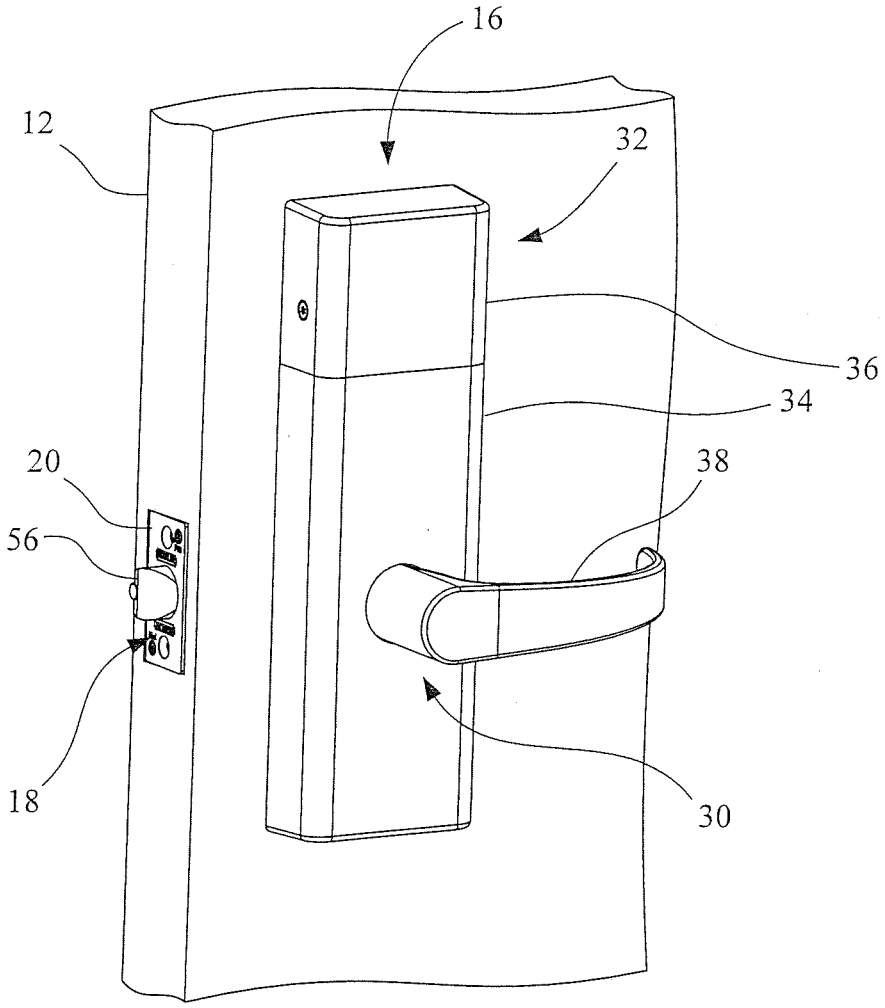
FIG. 3 is a perspective view of the interior lockset of the lock assembly of FIG. 1, as viewed from the interior of the door.

Referring now to the drawings and particularly to FIGS. 1-3, there is shown a lock assembly 10 in accordance with the present invention for mounting on a door 12, and which includes an exterior lockset 14, an interior lockset 16, a latch assembly 18, and a strike 20.

Exterior lockset 14 includes an exterior operator assembly 22, a credential reader 24, and an exterior escutcheon 26. Exterior operator assembly 22 includes an exterior operator handle 28.

Interior lockset 16 includes an interior operator assembly 30, a control electronics module 32, an interior escutcheon 34, and a battery cover 36. Interior operator assembly 30 includes an interior operator handle 38. Control electronics module 32 is electrically connected to credential reader 24.

Figure 4:
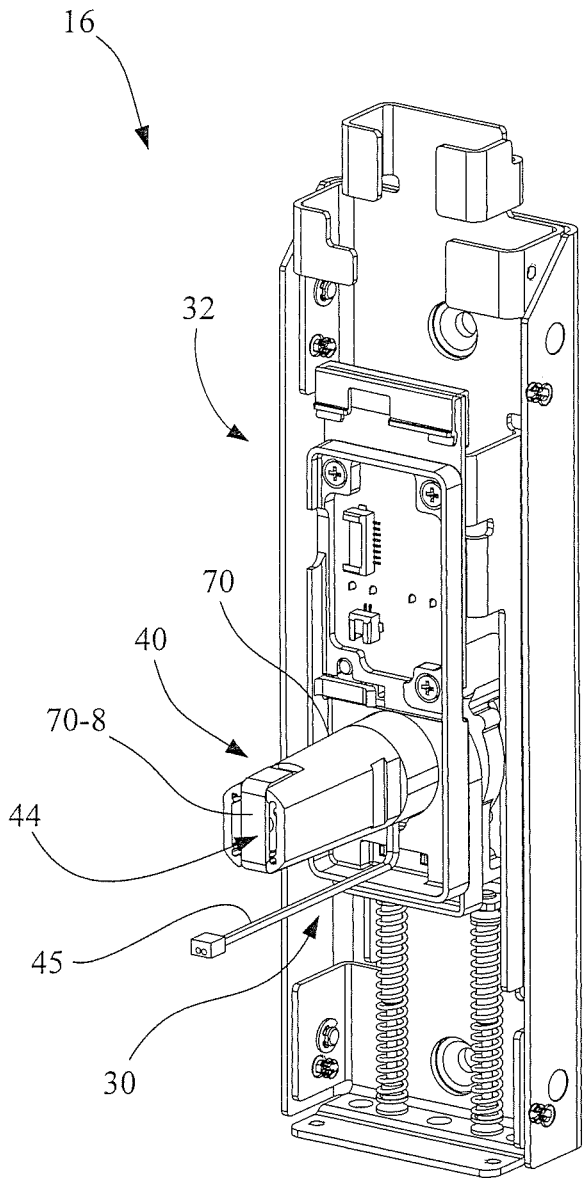
FIG. 4 is a perspective view of the interior lockset of FIG. 3, with the operator lever, escutcheon, and battery cover removed.
Figure 5:
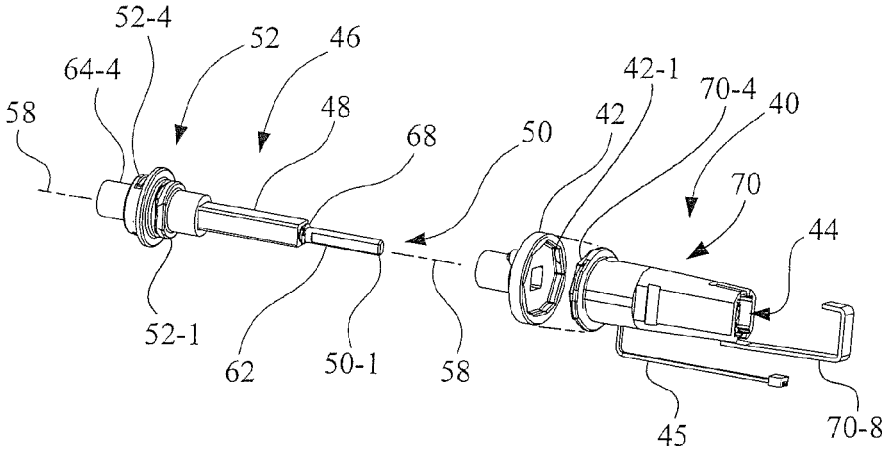
FIG. 5 is an exploded view of the handle sleeve assembly and spindle assembly of the lock assembly of FIG. 1.

Referring also to FIG. 4, interior operator assembly 30 includes a handle sleeve assembly 40. An exterior of handle sleeve assembly 40 is configured to mount interior operator handle 38. Referring also to FIG. 5, a distal end of handle sleeve assembly 40 is drivably coupled to an inside square drive spindle coupler 42. Within handle sleeve assembly 40 there is a chamber for mounting a motor drive assembly 44. Motor drive assembly 44 is electrically connected to control electronics module 32 via wire conductors 45.

Also shown in FIG. 5 is a spindle assembly 46 that includes an outer square spindle 48 within which there is rotatably received a locking spindle assembly 50. A coupling mechanism 52 is provided to selectively drivably couple exterior operator assembly 22 to outer square spindle 48. Locking spindle assembly 50 has a first end 50-1 that is mechanically coupled to a rotatable shaft of motor drive assembly 44. Locking spindle assembly 50 is operably coupled to coupling mechanism 52 to selectively couple and decouple exterior operator assembly 22 to outer square spindle 48, with the normal, or rest, state being a decoupled state.

Figure 6:
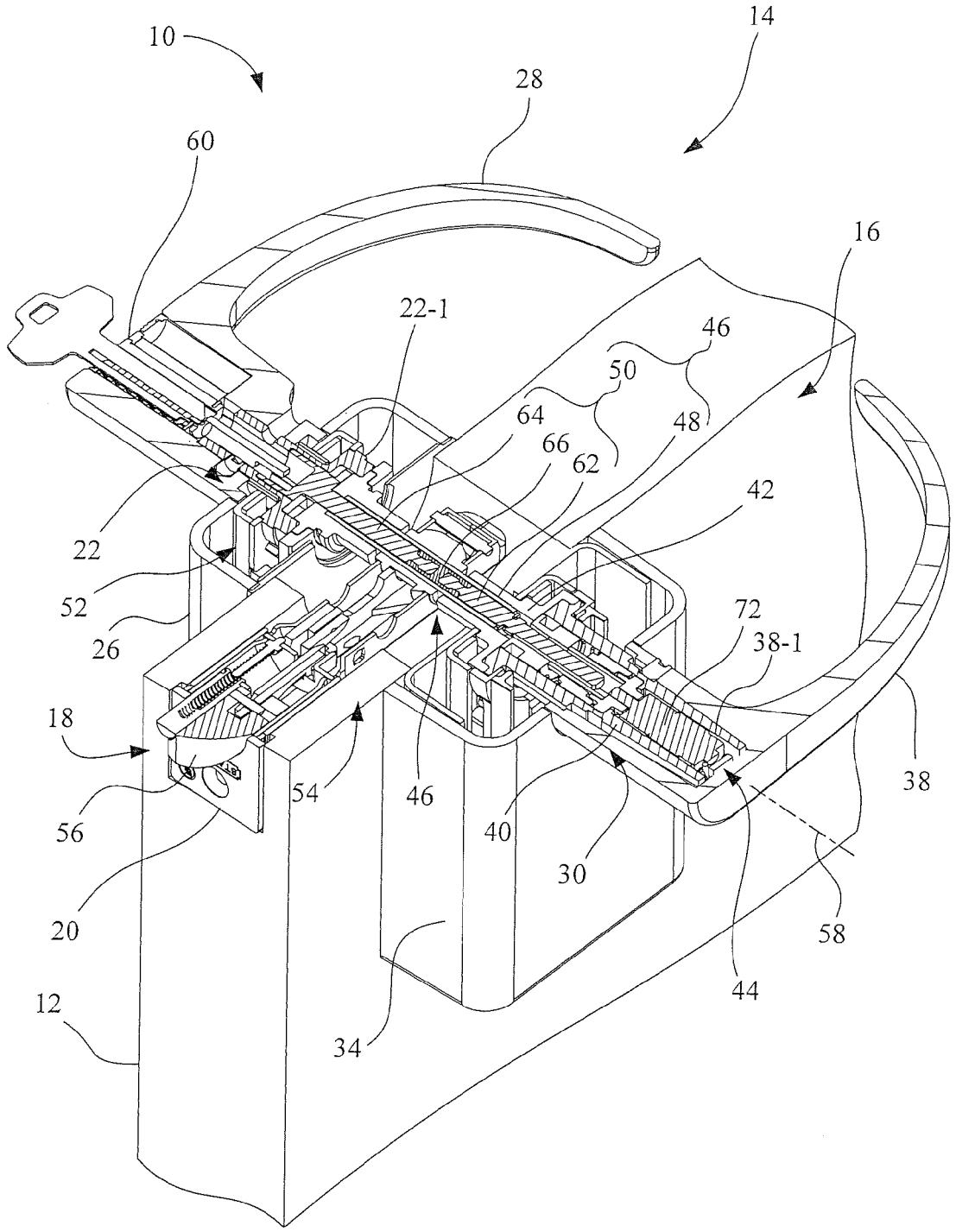
FIG. 6 is a sectioned perspective view of the lock assembly of FIG. 1 taken along plane 6-6 of FIG. 1.

Referring also to FIG. 6, latch assembly 18 is configured with a bolt actuator mechanism 54 and a retractable bolt 56, as is customary in the art. Bolt actuator mechanism 54 is operable by a rotation of outer square spindle 48 of spindle assembly 46 to retract bolt 56. As is illustrated in FIG. 6, exterior operator handle 28, interior operator handle 38, motor drive assembly 44 and spindle assembly 46 are longitudinally aligned along an axis 58.

Interior lockset 16 is configured such that during normal operation interior operator handle 38 is always operatively coupled to spindle assembly 46, and in particular, to outer square spindle 48 via inside square drive spindle coupler 42, and in turn to latch assembly 18. As such, in normal operation a rotation of interior operator handle 38 always will result in a retraction of bolt 56. Also, in normal operation motor drive assembly 44 is always operatively coupled to locking spindle assembly 50.

Referring to FIGS. 2 and 6, exterior lockset 14 is configured such that exterior operator handle 28 is selectively coupled to latch assembly 18. In a locked condition, exterior operator handle 28 is decoupled from spindle assembly 46, and thus a rotation of exterior operator handle 28 does not result in a retraction of bolt 56. In an unlocked condition, exterior operator handle 28 is coupled to spindle assembly 46 via coupling mechanism 52 to operate latch assembly 18, and thus a rotation of exterior operator handle 28 will result in a retraction of bolt 56.

The unlocked condition may be achieved by providing a valid credential, e.g., an RFID card, to be read by credential reader 24, which in turn sends a signal to control electronics module 32. Control electronics module 32 then compares the read credential to a database of stored authorized credentials, and if a match is found, responds by operating motor drive assembly 44 to rotate the inner portion, i.e., locking spindle assembly 50, of spindle assembly 46 to activate coupling mechanism 52 to couple exterior operator handle 28 to latch assembly 18 via coupling mechanism 52 and outer square spindle 48 (see also FIG. 5).

Additionally, exterior lockset 14 is provided with a mechanical override in the form of a key operated interchangeable keyed lock core 60 that is operatively coupled to coupling mechanism 52, such that a valid operator key may be used to effect a coupling of exterior operator handle 28 to latch assembly 18.

Figure 7:
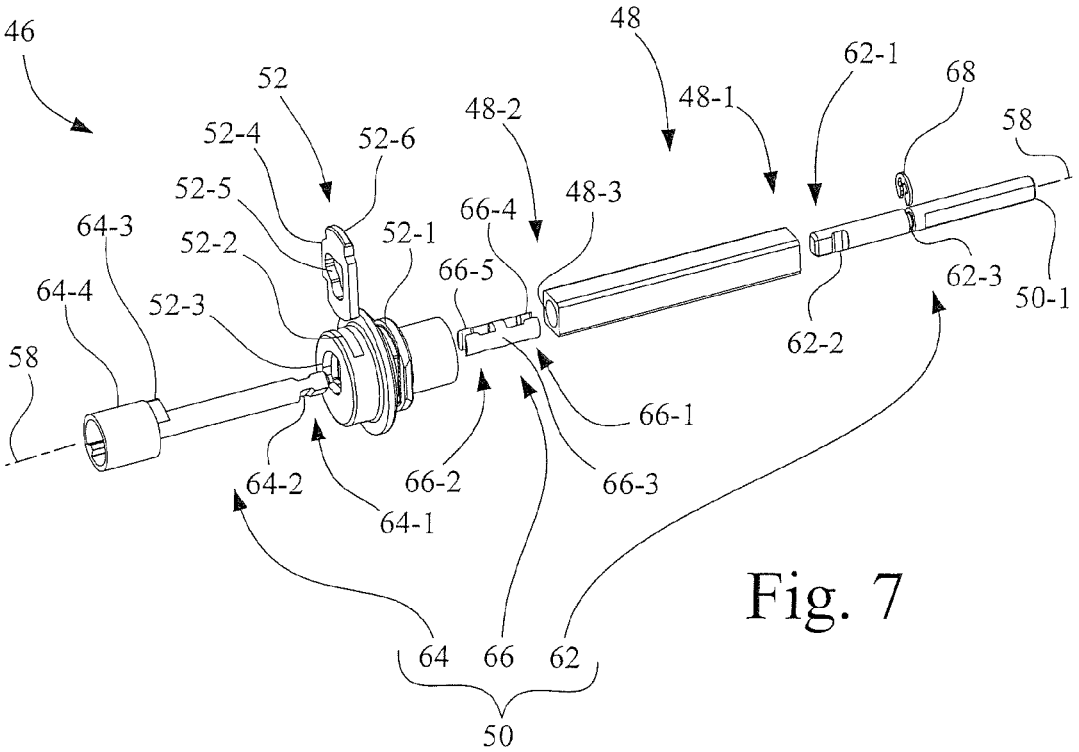
FIG. 7 is an exploded view of the spindle assembly of FIG. 5.

Referring now also to FIG. 7, spindle assembly 46 includes the outer square spindle 48. Outer square spindle 48 has a first end 48-1, a second end 48-2, and a longitudinal bore 48-3 that extends between first end 48-1 and second end 48-2. Longitudinal bore 48-3 of outer square spindle 48 is sized to rotatably receive locking spindle assembly 50. Second end 48-2 of outer square spindle 48 is configured to drivably connect to a body 52-1 of coupling mechanism 52.

Body 52-1 of coupling mechanism 52 includes a slot 52-2 and a longitudinal opening 52-3. Longitudinal opening 52-3 is co-axial with longitudinal bore 48-3 along axis 58. Slot 52-2 is arranged to perpendicularly intersect longitudinal opening 52-3. A slide member 52-4 is received in slot 52-2 in a sliding arrangement, such that slide member 52-4 is selectively extendable from body 52-1. Slide member 52-4 has a cam opening 52-5 and a coupling tab 52-6. Coupling tab 52-6 is configured to selectively engage a coupling portion 22-1 of exterior operator assembly 22, such that when so engaged, exterior operator handle 28 is rotatably coupled to outer square spindle 48 to operate latch assembly 18.

Locking spindle assembly 50 is a three piece elongate sub-assembly, generally round in cross-section, which transfers a torque function that is required to lock and unlock lock assembly 10 via the lifting and lowering of slide member 52-4 of coupling mechanism 52. More particularly, locking spindle assembly 50 includes a locking spindle tail 62, a locking actuator spindle 64, and a locking spindle link 66. Each of locking spindle tail 62, locking actuator spindle 64, and locking spindle link 66 has a cylindrical exterior portion that is received in a snug rotating fit within the longitudinal bore 48-3 of outer square spindle 48.

Locking spindle tail 62 has a coupling end 62-1 having a pair of diametrically opposed surface recesses 62-2. Likewise, locking actuator spindle 64 has a coupling end 64-1 having a pair of diametrically opposed surface recesses 64-2. In addition, locking actuator spindle 64 includes a cam protrusion 64-3 that is configured to be received in cam opening 52-5 of body 52-1 of coupling mechanism 52, so as to raise or lower slide member 52-4 based on a rotational position of cam protrusion 64-3. A head portion 64-4 of locking actuator spindle 64 is located opposite coupling end 64-1, with cam protrusion 64-3 interposed between head portion 64-4 and coupling end 64-1, and with cam protrusion 64-3 adjacent head portion 64-4.

Locking spindle link 66 is configured as an H-shaped structure having a pair of axially opposed U-shaped clip ends 66-1 and 66-2 that are separated by an interposed solid core 66-3. U-shaped clip end 66-1 includes a pair of diametrically opposed inwardly facing protrusions 66-4 sized and configured to engage the corresponding pair of diametrically opposed surface recesses 62-2 of locking spindle tail 62 in an interlocking and/or a snap fit, so as to connect locking spindle link 66 to locking spindle tail 62. U-shaped clip end 66-2 includes a pair of diametrically opposed inwardly facing protrusions 66-5 sized and configured to engage the corresponding pair of diametrically opposed surface recesses 64-2 of locking actuator spindle 64 in an interlocking and/or a snap fit, so as to connect locking spindle link 66 to locking actuator spindle 64.

Referring particularly to FIG. 7, to assemble spindle assembly 46, coupling end 64-1 of locking actuator spindle 64 is inserted through longitudinal opening 52-3 of body 52-1 of coupling mechanism 52, and through cam opening 52-5 of slide member 52-4. Head portion 64-4 serves as a stop to engage coupling mechanism 52 to position cam protrusion 64-3 in cam opening 52-5 of slide member 52-4. Coupling end 64-1 of locking actuator spindle 64 is then connected to U-shaped clip end 66-2 of locking spindle link 66. Coupling end 62-1 of locking spindle tail 62 is then connected to U-shaped clip end 66-1 of locking spindle link 66.

Locking spindle assembly 50 is then inserted, first end 50-1 first, through longitudinal bore 48-3 of outer square spindle 48, such that second end 48-2 of outer square spindle 48 drivably engages body 52-1 of coupling mechanism 52. A snap ring 68 is inserted into a snap ring groove 62-3 of locking spindle tail 62. The resulting assembled arrangement of spindle assembly 46 is illustrated in FIG. 5.

To aid in preventing the spread of fire, each of the outer square spindle 48 of spindle assembly 46 and the inner locking spindle link 66 of locking spindle assembly 50 that is received in longitudinal bore 48-3 of outer square spindle 48 may be made of a material having a relatively high melting temperature, such as steel or similar alloy. Each of locking spindle tail 62 and locking actuator spindle 64 may made of a non-steel material, such as zinc, aluminum, polymer, or other non-ferrous suitable alloy, having a relatively lower melting temperature.

Alternatively, the entirety of spindle assembly 46 may be made of steel or similar alloy having a relatively high melting temperature, and other fire safety features known in the art may be employed.

Referring to FIGS. 4-6 and 8, handle sleeve assembly 40 includes a housing 70 that contains and mounts motor drive assembly 44.

Motor drive assembly 44 includes a motor 72 and a clutch assembly 74 that are axially arranged along axis 58.

Housing 70 of handle sleeve assembly 40 has a proximal end 70-1 and a distal end 70-2, and has a slight taper between proximal end 70-1 and distal end 70-2. Housing 70 has an exterior shape including a plurality of flats 70-3 that corresponds to an interior shape of a mounting opening 38-1 in interior operator handle 38 to mount interior operator handle 38. At distal end 70-2 there is a multi-faceted polygonal male driver 70-4 configured to engage a corresponding driven opening 42-1 in the inside square drive spindle coupler 42 (see FIG. 5).

Housing 70 is hollow and includes a side wall 70-5 that defines a chamber 70-6 configured to receive and mount motor drive assembly 44. A portion of chamber 70-6 at proximal end 70-1 is substantially rectangular to match the exterior profile of motor 72 so as to prevent a rotational movement of motor 72 relative to housing 70. Proximal to distal end 70-2 there is formed a bore 70-7 in side wall 70-5 that is arranged perpendicular to axis 58, and is configured to slidably receive a sensor pin 73. A sliding clip 70-8 is used to axially retain motor drive assembly 44 in chamber 70-6 of housing 70.

Figure 8:
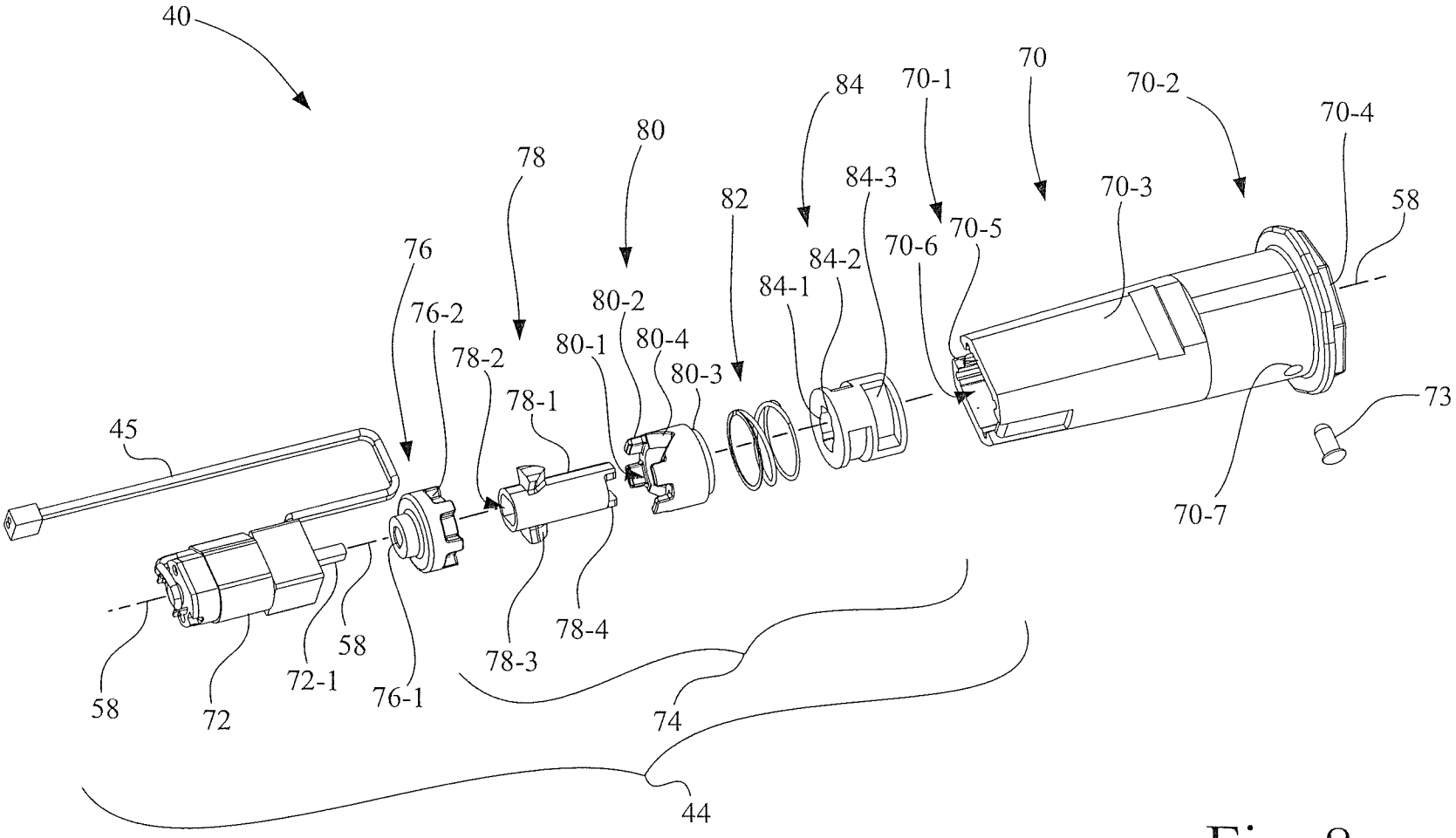
FIG. 8 is an exploded view of the handle sleeve assembly of FIGS. 4-6.

Referring to FIGS. 4 and 8, motor 72 is electrically connected to control electronics module 32 via the wire conductors 45. Motor 72 includes a rotatable motor shaft 72-1 which is drivably connected to clutch assembly 74 and is rotatable about axis 58, and is coaxial with outer square spindle 48 and the locking spindle assembly 50. Motor 72 may be, for example, a DC motor.

As shown in FIG. 8, clutch assembly 74 includes a motor clutch base 76, a motor clutch driver 78, a motor clutch 80, a motor clutch compression spring 82, and a sensor cam 84.

Motor clutch base 76 has an opening 76-1 that is mounted, e.g., in a press fit, to motor shaft 72-1 of motor 72. Motor clutch base 76 has a plurality of distal peripheral drive notches 76-2 located around the periphery of motor clutch base 76.

Motor clutch 80 includes a center bore 80-1, a plurality of proximal peripheral tabs 80-2 located around the periphery of the motor clutch 80, a distal annular recess 80-3 and a pair of diametrically opposed cam surfaces 80-4. The plurality of proximal peripheral tabs 80-2 is configured to be drivably received by the plurality of distal peripheral drive notches 76-2 of motor clutch base 76.

Axially interposed between motor clutch base 76 and motor clutch 80 is motor clutch driver 78. Motor clutch driver 78 includes an elongate shaft 78-1 having a drive opening 78-2 having drive flats, and is configured to drivably receive first end 50-1 of locking spindle tail 62 of locking spindle assembly 50 (see FIGS. 5 and 7). As such, a rotation of motor clutch driver 78 results in a direct rotation of locking spindle assembly 50. Extending radially outward from elongate shaft 78-1 is a pair of diametrically opposed cam protrusions 78-3 configured to be drivably engaged with the diametrically opposed cam surfaces 80-4 of motor clutch 80. Motor clutch driver 78 further includes a pair of diametrically opposed distal drive tabs 78-4.

Sensor cam 84 includes an opening 84-1 through which locking spindle tail 62 of locking spindle assembly 50 passes (see also FIG. 5). Opening 84-1 has a pair of diametrically opposed notches 84-2 configured to receive the pair of diametrically opposed distal drive tabs 78-4 of motor clutch driver 78.

Sensor cam 84 also includes a circumferential cam surface 84-3 which is engaged by sensor pin 73. A rotational position of circumferential cam surface 84-3 of sensor cam 84 is dependent on a rotational position of locking spindle assembly 50. Based on a rotational position of circumferential cam surface 84-3 of sensor cam 84, sensor pin 73 is raised or lowered, which is indicative of the locking status of lock assembly 10. In other words, as a result of following circumferential cam surface 84-3, sensor pin 73 is used to provide feedback to control electronics module 32 as to whether lock assembly 10 is in a locked or an unlocked state.

Motor clutch compression spring 82 is interposed between motor clutch 80 and sensor cam 84. More particularly, motor clutch compression spring 82 is received around elongate shaft 78-1 of motor clutch driver 78, and is fitted over distal annular recess 80-3 of motor clutch 80 to maintain the radial position of motor clutch compression spring 82.

Thus, in accordance with an aspect of the present invention, direct axial rotation output from motor 72 of motor drive assembly 44 is used to drive locking spindle assembly 50 via clutch assembly 74, and in turn, to operatively drive coupling mechanism 52 (see FIGS. 5-7) to effect locking and unlocking of lock assembly 10. Motor drive assembly 44 and locking spindle assembly 50 extend from the non-keyed interior side of lock assembly 10 through door 12 to the keyed exterior side of lock assembly 10. By using a direct axial in-line connection from the motor drive assembly 44 to coupling mechanism 52 via locking spindle assembly 50, motor 72 can be mounted on the center axis 58 of exterior operator handle 28 and interior operator assembly 30, and thus motor drive assembly 44 can therefore be mounted inside the handle sleeve assembly 40 of interior operator assembly 30, and accordingly, inside the mounting opening 38-1 of interior operator handle 38 on the non-keyed side of door 12.

Since motor 72 is mounted inside of interior operator handle 38, every time that the lever of interior operator handle 38 is rotated clockwise or counterclockwise, motor 72 also rotates clockwise or counterclockwise along with the locking spindle assembly 50. When the exterior operator handle 28 on the keyed side of door 12 is locked, slide member 52-4, i.e., locking plate, of coupling mechanism 52 is disengaged and does not rotate interior operator handle 38 or motor 72 on the non-keyed side of door 12. However, when slide member 52-4, i.e., locking plate, of coupling mechanism 52 is engaged, any rotation from the exterior operator handle 28 on the keyed side of door 12 will cause interior operator handle 38 and motor 72 on the non-keyed side of door 12 to also rotate.

Clutch assembly 74 of motor drive assembly 44 allows the output torque from motor 72 to be transmitted to the three piece locking spindle assembly 50, but also will clutch, i.e., slip, and will allow motor shaft 72-1 to spin freely if there is enough resistance from the slide member 52-4, i.e., locking plate, of coupling mechanism 52 in attempting to move slide member 52-4 into a locked or unlocked position.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lock assembly for a door, comprising:

an exterior operator assembly having an exterior operator handle;

an interior operator assembly having an interior operator handle, the interior operator handle having a mounting opening;

a latch assembly having a bolt actuator mechanism and a bolt;

an outer spindle operatively coupled to the latch assembly, drivably coupled to the interior operator assembly, and the outer spindle having a longitudinal bore and being rotatable about a first axis;

a coupling mechanism drivably coupled to the outer spindle;

a locking spindle assembly rotatably received in the longitudinal bore and rotatable about the first axis, and configured to selectively operate the coupling mechanism to drivably couple the exterior operator assembly to the outer spindle;

a motor drive assembly including a motor having a motor shaft, the motor being positioned inside the mounting opening of the interior operator handle, the motor shaft being drivably coupled to the locking spindle assembly to operate the coupling mechanism when the motor drive assembly is actuated, wherein the coupling mechanism includes a slide member having a coupling tab and a cam opening, the coupling tab configured to selectively engage a coupling portion of the exterior operator assembly; and the locking spindle assembly includes a cam protrusion that is configured to be received in the cam opening of the slide member of the coupling mechanism, the cam protrusion configured to raise or lower the slide member based on a rotational position of the cam protrusion.

2. The lock assembly of claim 1, configured such that the motor shaft is coaxial with the outer spindle and the locking spindle assembly with respect to the first axis.

3. The lock assembly of claim 1, comprising a clutch mechanism interposed between the motor shaft and the locking spindle assembly.

4. The lock assembly of claim 1, the interior operator assembly including a handle sleeve assembly configured to contain the motor, and configured to mount the interior operator handle in driving engagement.

5. The lock assembly of claim 1, the interior operator assembly including a housing configured to contain the motor, the housing having an exterior shape that corresponds to an interior shape of the mounting opening of the interior operator handle for mounting the interior operator handle in driving engagement for driving the outer spindle.

6. The lock assembly of claim 5, the housing having a proximal end and a distal end, and having a taper between the proximal end and the distal end, the housing having a plurality of exterior flats that corresponds to the interior shape of the mounting opening in the interior operator handle for driving the outer spindle.

7. The lock assembly of claim 6, comprising a spindle coupler connected to a first end of the outer spindle, the spindle coupler having a driven opening, the housing of the handle sleeve assembly having at the distal end a multi-faceted polygonal male driver configured to engage the driven opening of the spindle coupler.

8. The lock assembly of claim 7, the locking spindle assembly including a locking spindle tail member and a locking actuator spindle, the locking spindle tail member configured to extend from the first end of the outer spindle for drivable coupling to the motor shaft, and the locking actuator spindle configured to extend from a second end of the outer spindle, the locking actuator spindle configured to selectively operate the coupling mechanism to drivably couple the exterior operator assembly to the outer spindle.

9. The lock assembly of claim 8, wherein:

the coupling mechanism includes a slide member having a coupling tab and a cam opening, the coupling tab configured to selectively engage a coupling portion of the exterior operator assembly; and the locking actuator spindle includes a cam protrusion that is configured to be received in the cam opening of the slide member of the coupling mechanism, the cam protrusion configured to raise or lower the slide member based on a rotational position of the cam protrusion.

10. A lock assembly for use with a door, comprising:

a latch assembly having a bolt actuator mechanism and a bolt;

an outer spindle operatively coupled to the bolt actuator mechanism of the latch assembly, the outer spindle having a first end and a second end, the outer spindle having a longitudinal bore and configured for rotation about a first axis;

an exterior lockset including an exterior operator assembly and a credential reader, the exterior operator assembly having an exterior operator handle;

a coupling mechanism drivably coupled to the second end of the outer spindle, and configured to selectively couple the exterior operator assembly to the outer spindle;

a locking spindle assembly rotatably received in the longitudinal bore of the outer spindle for rotation about the first axis, the locking spindle assembly including a locking spindle tail member that extends from the first end of the outer spindle, and a locking actuator spindle that extends from the second end of the outer spindle, the locking actuator spindle configured to selectively operate the coupling mechanism to drivably couple the exterior operator assembly to the outer spindle;

an interior lockset including an interior operator assembly and a motor drive assembly, the interior operator assembly including an interior operator handle drivably coupled to the first end of the outer spindle, the interior operator handle having a mounting opening configured to receive the motor drive assembly, the motor drive assembly being electrically coupled to the credential reader, the credential reader configured to selectively actuate the motor drive assembly, the motor drive assembly including a motor having a motor shaft rotatable about the first axis, the motor shaft being drivably coupled to the locking spindle tail member of the locking spindle assembly to operate the coupling mechanism when the motor drive assembly is actuated, wherein the coupling mechanism includes a slide member having a coupling tab and a cam opening, the coupling tab configured to selectively engage a coupling portion of the exterior operator assembly; and the locking actuator spindle includes a cam protrusion that is configured to be received in the cam opening of the slide member of the coupling mechanism, the cam protrusion configured to raise or lower the slide member based on a rotational position of the cam protrusion.

11. The lock assembly of claim 10, comprising a clutch assembly interposed between the motor shaft and the locking spindle tail member.

12. The lock assembly of claim 10, the interior operator assembly including a handle sleeve assembly configured to contain the motor, and the handle sleeve assembly configured to mount the interior operator handle in driving engagement for driving the outer spindle.

13. The lock assembly of claim 10, the interior operator assembly including a housing configured to contain the motor, the housing having an exterior shape that corresponds to an interior shape of the mounting opening of the interior operator handle for mounting the interior operator handle in driving engagement for driving the outer spindle.

14. The lock assembly of claim 13, the housing having a proximal end and a distal end, and having a taper between the proximal end and the distal end, the housing having a plurality of exterior flats that corresponds to the interior shape of the mounting opening in the interior operator handle.

15. The lock assembly of claim 14, comprising a spindle coupler connected to the first end of the outer spindle, the spindle coupler having a driven opening, the housing of the handle sleeve assembly having at the distal end a multi-faceted polygonal male driver configured to engage the driven opening of the spindle coupler.

* * * * *